United States Patent [19]

Moody

[11] 4,416,480

[45] Nov. 22, 1983

[54] PNEUMATIC RELEASE FOR LOAD HOOK

[75] Inventor: Jack M. Moody, Milwaukie, Oreg.

[73] Assignee: Cranston Machinery Co., Inc., Oak Grove, Oreg.

[21] Appl. No.: 299,810

[22] Filed: Sep. 8, 1981

[51] Int. Cl.[3] ..... B66C 1/38

[52] U.S. Cl. ..... 294/83 R; 294/81 R; 294/88

[58] Field of Search ..... 294/75, 76, 78 R, 81 R, 294/82 R, 83 R, 83 A, 86 R, 88

[56] References Cited

U.S. PATENT DOCUMENTS

| | | | |
|---|---|---|---|
| 2,370,528 | 2/1945 | Fontaine | 294/88 |
| 2,998,277 | 8/1961 | Himel | 294/75 |
| 3,101,213 | 8/1963 | Elsner | 294/83 R |
| 3,310,335 | 3/1967 | Shuey | 294/88 |
| 3,401,739 | 9/1968 | Opletal | 294/88 X |
| 4,095,833 | 6/1978 | Lewis | 294/83 R |
| 4,293,155 | 10/1981 | Grant | 294/75 |

*Primary Examiner*—Johnny D. Cherry

*Attorney, Agent, or Firm*—Lee R. Schermerhorn

[57] ABSTRACT

The lifting of a load moves a piston to pump a charge of air into a small compressed air reservoir above a load hook. A remote control radio signal opens a valve to transmit the air pressure to the load hook causing the hook to release itself from its load. The device may be incorporated in a self contained module associated with a single load hook or it may be adapted to a lifting frame having a plurality of releasable load hooks. Also, the device may be arranged to produce the pumping stroke of the piston by lowering the lifting frame down on top of the load as the load is lowered onto a support.

6 Claims, 10 Drawing Figures

LOAD

PNEUMATIC RELEASE FOR LOAD HOOK

BACKGROUND OF THE INVENTION

This invention relates to a remote controlled pneumatic release device for a load hook which is releasable by pneumatic pressure.

U.S. Pat. No. 4,095,833 describes a pneumatic-controlled releasing hook device for releasing a load after the load has been lifted and moved to a different location, without requiring manual manipulation of the hook to disengage it from the load. The releasing mechanism in the hook is operated by compressed air whereby a compressed air line must follow alongside the lifting cable or chain to a compressed air reservoir in the crane or other lifting device. Such an air line is the cause of considerable trouble in the routine operation of the crane.

There is a need for a less complicated and more troublefree mechanism for releasing such load hooks. In particular, it is desired to eliminate the air line extending from the crane hook alongside the lifting cable back to the compressed air reservoir, and to provide an improved type of remote control for the hook release function.

SUMMARY OF THE INVENTION

The present device contains a small compressed air reservoir adjacent to the load hook whereby it is not necessary to extend a compressed air line back along the lifting cable to a remote compressed air reservoir. Only a small amount of air is required for each operation of the release mechanism in the hook. An air pumping cylinder and piston in the present device are capable of supplying considerably more air than is needed for each operation of the hook release mechanism.

This is accomplished by causing the lifting tension on the hook to move the piston through a single pumping stroke each time a load is lifted. Only a small portion of the pumped air is used to release the hook after the load has been moved to its new position. The release action is preferably accomplished by remote control instruments such as a portable radio transmitter and a radio receiver in the device which controls a solenoid valve associated with the compressed air reservoir.

For use with a single hook the present device may be incorporated in a small self contained power and control module connected in the hook suspension line near the hook. Such a module contains the air compression cylinder and piston, compressed air reservoir, solenoid valve, radio receiver and batteries for operating the solenoid valve, and radio receiver. A short air hose extends from the module to the hook.

The invention is also applied to a lifting frame having a plurality of pneumatic-controlled releasing hooks. In this modification the air pumping cylinder and piston, compressed air reservoir, radio receiver, solenoid valve and batteries are contained in the lifting frame. A pumping stroke of the piston is produced by an air pump actuating cable associated with the lifting cables for the lifting frame.

In another modification the pumping stroke of the piston is produced by lowering the lifting frame down on top of the load as the load is lowered onto a support.

The invention will be better understood and additional objects and advantages will become apparent from the following description of the preferred embodiments illustrated in the accompanying drawings. Various changes may be made in the details of construction and arrangement of parts and certain features may be used without others. All such modifications within the scope of the appended claims are included in the invention.

DESCRIPTION OF THE PREFERRED EMBODIMENTS

Figures 1, 2, 3, 6:
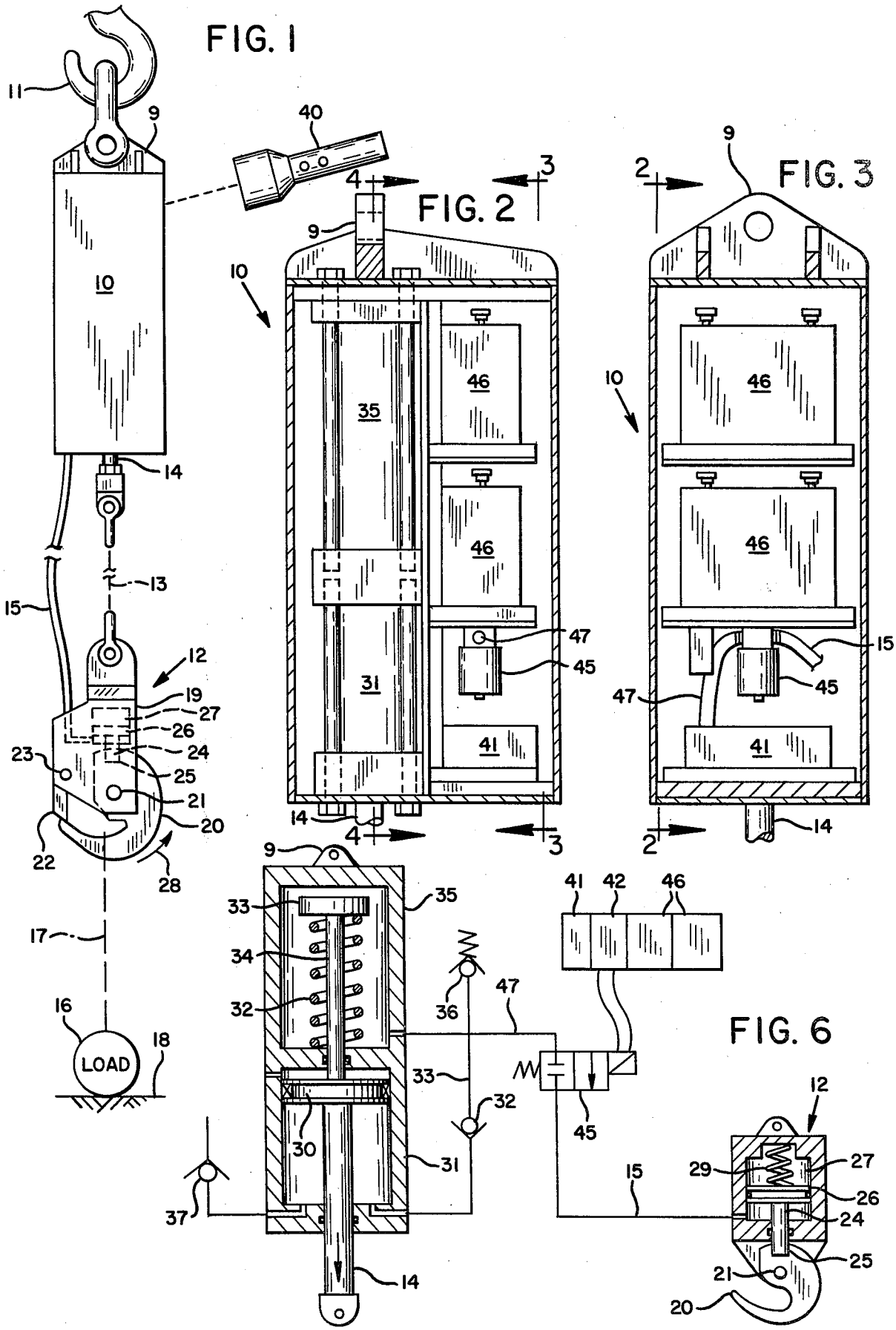
FIG. 1 is a side elevation view of the first embodiment wherein the novel features of the invention are contained in a single module for controlling a single load hook.
FIG. 2 is a vertical sectional view of the module on the line 2—2 in FIG. 3.
FIG. 3 is a section on the line 3—3 in FIG. 2.
FIG. 6 is a schematic diagram of the air pressure system in FIG. 1-5.

In FIG. 1 the upper end 9 of module 10 is supported by a crane hook 11. Releasing hook 12 is supported by a chain or cable 13 connected with a piston rod 14 extending from the lower end of module 10. Releasing hook 12 is released by compressed air supplied by an air line 15 from module 10.

A load 16 is connected by a chain or cable 17 from releasing hook 12. In FIG. 1 the load 16 rests on a support 18 whereby the piston rod 14 is not extended, as will be presently described.

Releasing hook 12 is similar to, but not necessarily identical to, the releasing hook device described in the said U.S. Pat. No. 4,095,833. The features of importance for the present purpose will be described. A body member 19 has a load carrying hook 20 pivotally mounted on a horizontal pivot pin 21. A latch 22 is pivotally mounted on a horizontal pivot pin 23 and spring actuated to closed position as shown.

Hook 20 is normally retained in load carrying position by a latch pin 24 engaged in a recess 25 in the upper portion of hook 20. Latch pin 24 is connected with a piston 26 in a vertical cylinder 27 in the body 19. Piston 26 and latch pin 24 are normally depressed into locked position as shown by a compression spring 29 (FIG. 6) above the piston.

When hook 20 is relieved of the weight of load 16 latch pin 24 may be retracted upward by supplying compressed air through line 15 to the lower end of cylinder 27 under the piston 26. Then when hook 11 and the releasing hook 20 are lifted sufficiently to tension the cable 17 the hook 20 will rotate freely in the direction of arrow 28 to release the load cable 17 without any manual manipulation.

The objection to the release operation as thus disclosed in said U.S. Pat. No. 4,095,833 is that it requires an air pressure line extending back from cylinder 27 to an air pressure reservoir in the crane.

The present invention involves the module 10 for supplying compressed air to air line 15 without requiring a compressed air line extending upward from hook 11.

Figure 4:
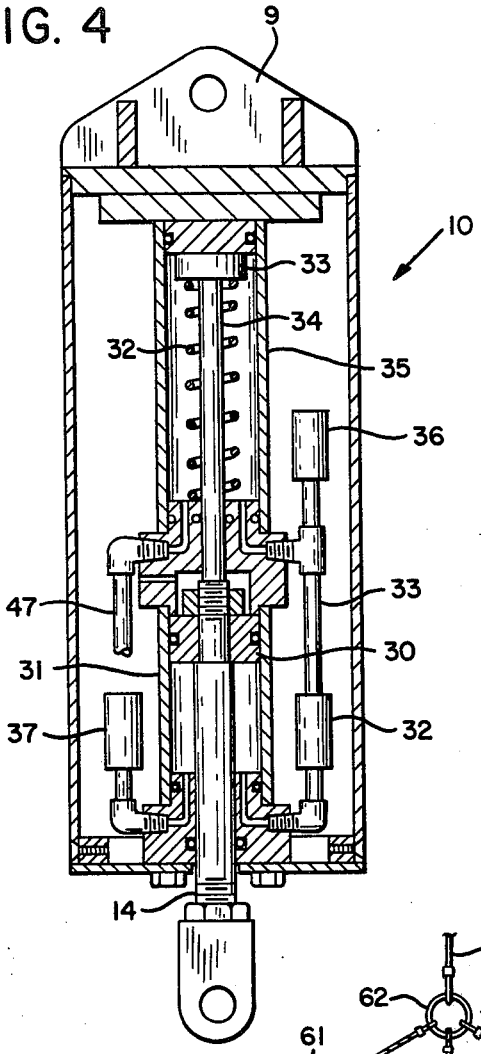
FIG. 4 is section on the line 4—4 in FIG. 2 showing the pumping piston in retracted position.

Referring now to the module 10 in FIG. 4, piston rod 14 is connected to a piston 30 in a vertical cylinder 31. Piston 30 is normally retracted to its upper position by a compression spring 32 which presses upward against an abutment 33 on the upper end of a piston rod extension 34 in a small cylindrical compressed air reservoir 35.

Figure 5:
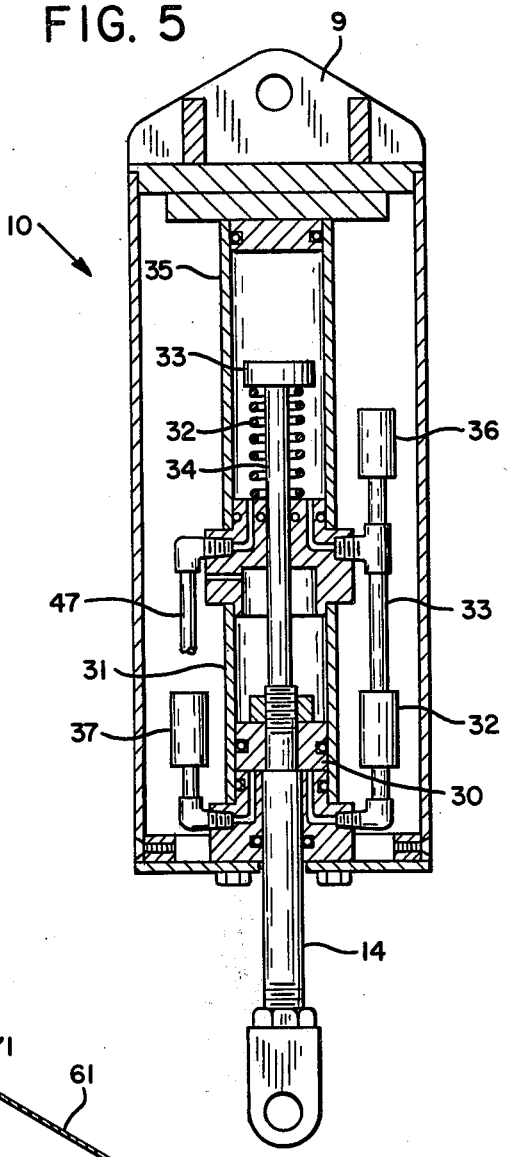
FIG. 5 is a view similar to FIG. 4 showing the pumping piston in extended position.

When the load 15 is lifted, piston rod 14 and piston 30 are pulled downward in cylinder 31 to pump air through a check valve 32 and connection 33 into compressed air reservoir 35 as shown in FIG. 5. Relief valve 36 limits the pressure in reservoir 35 to approximately 100 pounds per square inch. The air which is thus pumped into reservoir 35 is supplied through air intake check valve 37 by the action of spring 32 moving piston 30 upward to its FIG. 4 position when the tension on lifting cable 17 is relaxed.

Referring now to FIGS. 1 and 6, a signal from a portable radio transmitter 40 is received by radio receiver 41 to close a switch 42 and energize solenoid valve 45. Batteries 46 provide the power supply for radio receiver 41 and solenoid valve 45. The energization of solenoid valve 45 opens the valve to transmit air pressure from compressed air reservoir 35 through air line connections 47 and 15 to retract the latch pin 24 and release the hook 20 from the load as previously described.

Reservoir 35 is precharged initially and from that time on the air charging is achieved during operation. Each time a lift is made, piston 30 makes a pumping stroke and delivers a charge of air to reservoir 35. This charge is far in excess of the amount required to operate a single load hook 12.

Figure 7:
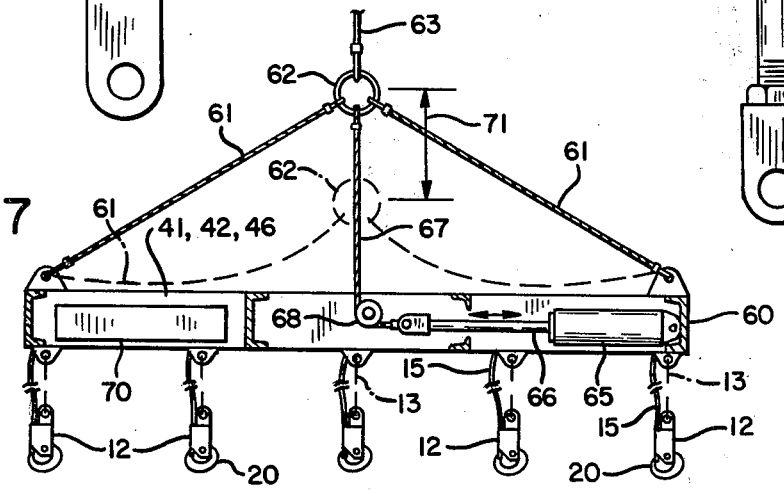
FIG. 7 is a side elevation view with parts broken away showing a second embodiment having a lifting frame with a plurality of load hooks.
Figure 8:
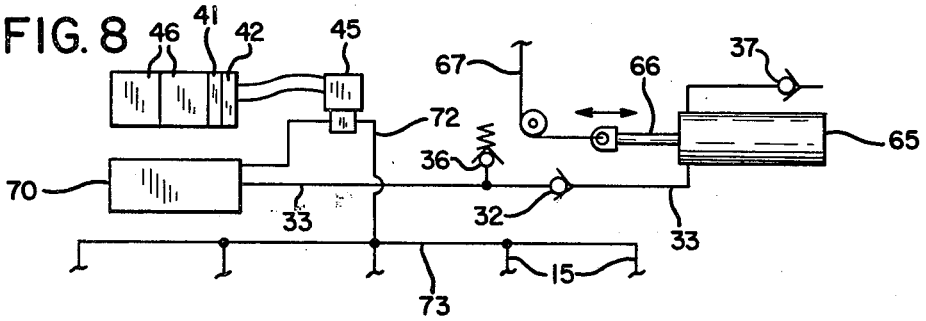
FIG. 8 is schematic diagram of the air pressure system in FIG. 7.

In the modification in FIGS. 7 and 8 the lifting frame 60 is supported by sling cables 61 from a ring 62 on a crane cable 63. Lifting frame 60 carries a plurality of the pneumatic-controlled releasing hook devices, or load hooks, 12 for carrying a load or a plurality of loads. Air pumping cylinder 65 has a piston rod 66 which is normally retracted by an internal spring in the same manner as compression spring 32 in FIG. 4. Piston rod 66 is connected with air pump actuating cable 67 which passes around a pulley 68 and is connected to lifting ring 62.

When frame 60 is lifted by lifting ring 62 to tension the lifting cables 61 as shown in solid lines in FIG. 7, the piston rod 66 is pulled outward to pump a charge of air into compressed air reservoir 70 similar to the pumping action described in connection with FIG. 4.

When frame 60 and the load carried by hooks 12 are lowered onto a support the lifting cables 61 and air pump actuating cable 67 are slackened to their broken line positions by the lowering of lifting ring 62 through the distance indicated by dimension line 71. This allows the internal spring in cylinder 65 to retract the piston rod 66 and cause fresh air intake into the rod end of cylinder 65 as described in connection with FIG. 4.

As shown in FIG. 8 the lifting frame 60 also carries the solenoid valve 45, radio receiver 41, switch 42 and batteries 46 as referred to in FIG. 6 in connection with the first embodiment. The opening of solenoid valve 45 in response to a radio signal from a portable radio transmitter 40 as described in connection with FIG. 1 transmits air pressure from reservoir 70 through connection 72 and a manifold air line 73 to the individual air lines 15 connected to the several load hooks 12. This releases all of the hooks 20 from the load or from their respective loads.

Figure 9:
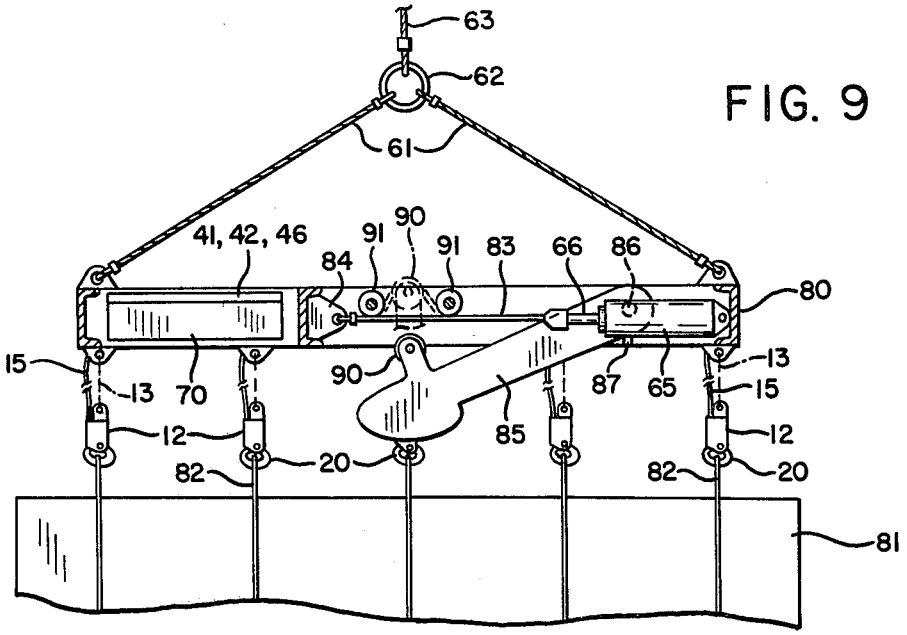
FIG. 9 is a side elevation view with parts broken away showing a third embodiment in lifting position.
Figure 10:
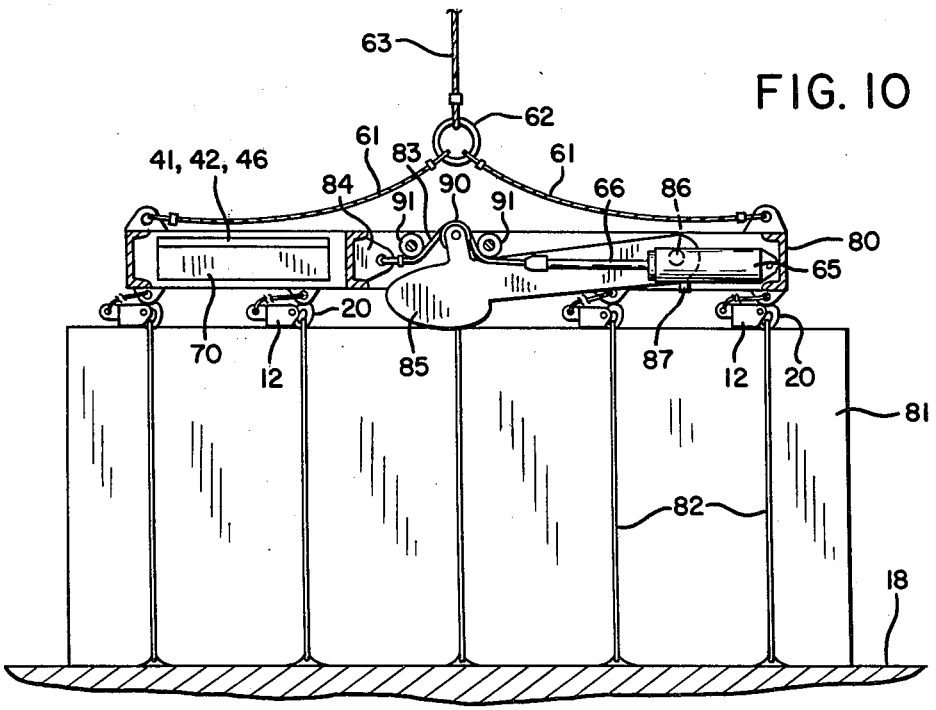
FIG. 10 is a similar view of the third embodiment in rest position.

In the modification shown in FIGS. 9 and 10 the lifting frame 80 is supported by four sling cables 61 from a ring 62 on a crane cable 63 as in FIG. 7. Ring 62 serves as lifting means for everything below it. Lifting frame 80 is a rectuangular frame carrying a plurality of the pneumatic-controlled releasing hook devices, or load hooks, 12 which carry a load or a plurality of loads. In this illustration the load 81 comprises a bale of resilient material having a plurality of banding straps 82 engaged by the load hooks 12, the near side of frame 80 being broken away whereby only the load hooks 12 on the far side of the frame appear in the drawings.

Air pumping cylinder 65 has a piston rod 66 which is normally retracted by an internal spring in the same manner as compression spring 32 in FIG. 4. Piston rod 66 is connected with an air pump actuating cable 83 which is anchored at its opposite end to a bracket 84 on frame 80. Lifting frame 80 also contains compressed air reservoir 70, radio receiver 41, switch 42, batteries 46 and a spring closed solenoid valve 45 (not shown) as in FIGS. 7 and 8.

A pump actuator arm 85 is pivotally mounted on a horizontal pivot pin 86 in frame 80 and equipped with suitable stop means 87 so as to project a short distance below the underside of frame 80 when the load 81 is being lifted, as shown in FIG. 9.

When the load 81 is lowered onto a support 18 and support ring 62 dropped sufficiently to relax the lifting sling cables 61 as shown in FIG. 10 the lower end of arm 85 engages the top of load 81 swinging the arm 85 upward and causing a roller 90 on the arm to deflect pump actuating cable 83 up between a pair of sheaves 91 on the frame 80. This extends the piston rod 66 to pump a charge of air into the compressed air reservoir 70.

In practice it is not necessary to actually rest the lifting frame 80 on top of bundle 81 and the sling cables 61 do not have to be relaxed as shown in FIG. 10. The necessary pumping stroke of piston rod 66 is produced by merely lowering the lifting frame 80 sufficiently close to the top of the load 81 to cause the arm 85 to engage the top of the load and pull the piston rod 66 outward to some extent. As previously explained, a full pumping stroke of piston rod 66 is not necessary each time a load is set down because the releasing hooks 12 require so little air for release operation.

When the load hooks 12 are relieved of load they may be caused to release the bale strapping bands 82 by the action of portable radio transmitter 40 in FIG. 1 which opens solenoid valve 45 as explained in connection with FIG. 8 and transmits pneumatic pressure through individual air lines 15 to all the load hooks 12.

When a new load is lifted, arm 85 drops down to its FIG. 9 position allowing the internal retracting spring in pumping cylinder 65 to retract the piston rod 66 in preparation for the next charging stroke of the piston rod.

Thus an air pumping stroke of piston rod 14 in FIG. 1 and piston rod 66 in FIG. 7 is produced each time a load is lifted while the pumping stroke of piston rod 66 in FIGS. 9 and 10 is produced each time a load is set down on a support. This keeps the compressed air reservoir 35 in FIGS. 4 and 6 and the compressed air reservoir 70 in FIGS. 7–10 charged with air under the necessary pressure at all times for releasing the load hooks 12 when a radio signal is received from portable transmitter 40 in FIG. 1 to open the solenoid valve 45.

What is claimed is:

1. A pneumatic release device for a load hook which is releasable by pneumatic pressure, comprising a compressed air reservoir connected through a valve to said load hook to release a load from said hook, an air pump cylinder and piston operable by the application of said load to the hook to move said piston in an air pumping stroke to pump air into said reservoir, and means for reversing said piston stroke when load tension is removed from said hook, said device comprising a self contained power and control module containing said air pump cylinder and piston, air reservoir and valve, said load hook being connected to a piston rod in said piston, and an air pressure line extending from said module to said load hook.

2. A pneumatic release device for a load hook which is releasable by pneumatic pressure, comprising a compressed air reservoir connected through a valve to said load hook to release a load from said hook, an air pump cylinder and piston operable by the application of said load to the hook to move said piston in an air pumping stroke to pump air into said reservoir, and means for reversing said piston stroke when load tension is removed from said hook, said device comprising a self contained power and control module containing said air pump cylinder and piston, air reservoir and valve, said module comprising a vertical housing having a crane hook lifting connection on its upper end, said air pump piston having a piston rod extending from the lower end of said housing for connection with said load hook, said compresed air reservoir comprising a second cylinder aligned with said air pump cylinder, and an extension on said piston rod projecting into said air reservoir cylinder, said means for reversing said piston stroke comprising a spring in said air reservoir cylinder operable on said piston rod extension.

3. A self contained power and control module for releasing a pneumatic-controlled load hook comprising a vertical housing having a crane hook lifting connection on its upper end, an air pump piston having a vertical piston rod extending from the lower end of said housing for connection with said load hook, a vertical air pump cylinder for said piston, a compressed air reservoir comprising a second vertical cylinder above said air pump cylinder, the application of a load to said hook moving said piston in an air pumping stroke to pump air into said air reservoir cylinder, an extension on said piston rod projecting into said air reservoir cylinder, a spring in said air reservoir cylinder operable on said piston rod to reverse said piston stroke when there is no load on said hook, an air line connection through a valve from said air reservoir cylinder to said hook, and a remote control receiver for actuating said valve.

4. A module as defined in claim 3, said remote control receiver being a radio receiver and said valve being a solenoid valve, and said module containing power supply batteries for said radio receiver and solenoid valve.

5. A pneumatic release device for a load hook which is releasable by pneumatic pressure, comprising a compressed air reservoir connected through a valve to said load hook to release a load from said hook, lifting means for said load hook, an air pump cylinder and piston operable by vertical movement in one direction of said lifting means relative to said load hook and a load connected thereto to move said piston in an air pumping stroke to pump air into said reservoir, and means for reversing said piston stroke when the direction of said vertical movement of said lifting means is reversed, said device including a lifting frame supported by said lifting means, said air reservoir, valve, cylinder and piston being contained in said lifting frame, and said lifting hook being supported by said lifting frame, said air pump piston being moved in said pumping stroke by the downward movement of said lifting frame relative to said load when said load is lowered onto a support.

6. A device as defined in claim 5, said air pump piston being moved in said pumping stroke by the upward movement of an arm extending below said lifting frame and arranged to engage the top of said load when said lifting frame is lowered toward the load.

* * * * *